US009278824B2

(12) United States Patent
Hamano et al.

(10) Patent No.: US 9,278,824 B2
(45) Date of Patent: Mar. 8, 2016

(54) RECORDING APPARATUS AND WINDING METHOD

(71) Applicant: SEIKO EPSON CORPORATION, Tokyo (JP)

(72) Inventors: Ryo Hamano, Matsumoto (JP); Toru Hayashi, Suwa (JP); Yuya Saito, Shiojiri (JP); Takeshi Shiode, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/617,749

(22) Filed: Feb. 9, 2015

(65) Prior Publication Data

US 2015/0225196 A1 Aug. 13, 2015

(30) Foreign Application Priority Data

Feb. 10, 2014 (JP) ..... 2014-023084

(51) Int. Cl.
*B65H 18/26* (2006.01)

(52) U.S. Cl.
CPC ..... *B65H 18/26* (2013.01)

(58) Field of Classification Search
CPC ..... B41J 15/16; B65H 23/195
See application file for complete search history.

(56) References Cited

U.S. PATENT DOCUMENTS

| | | | | |
|---|---|---|---|---|
| 6,193,183 | B1 * | 2/2001 | Yoshizawa | 242/334.3 |
| 2002/0113160 | A1 * | 8/2002 | Niioka et al. | 242/528 |
| 2009/0226235 | A1 * | 9/2009 | Kobayashi | B41J 15/04 400/614 |
| 2012/0050435 | A1 * | 3/2012 | Sugiyama et al. | 347/102 |
| 2012/0050438 | A1 * | 3/2012 | Wada | 347/104 |
| 2013/0028647 | A1 * | 1/2013 | Okada | B65H 23/06 400/583 |

FOREIGN PATENT DOCUMENTS

JP 2006-151651 6/2006

* cited by examiner

*Primary Examiner* — Stephen Meier
*Assistant Examiner* — John P Zimmermann
(74) *Attorney, Agent, or Firm* — Workman Nydegger

(57) ABSTRACT

A recording apparatus includes a transportation section of a recording medium; a winding section of the recording medium; and a control section that controls transportation of the recording medium by controlling the transportation section and the winding section. The control section switches a threshold of a torque limit of the winding section when winding the recording medium at the winding section by synchronizing with an operation of the transportation section. According to the recording apparatus having such a configuration, an occurrence of defects is suppressed when winding the recording medium.

9 Claims, 5 Drawing Sheets

RECORDING APPARATUS AND WINDING METHOD

BACKGROUND

1. Technical Field

The present invention relates to a recording apparatus and a winding method.

2. Related Art

In the related art, a recording apparatus including a winding section that winds a recording medium on which recording is performed by a recording section is used. For example, a recording apparatus that includes a movable tension roller which applies tension to the recorded recording medium and can correct a winding speed depending on a position of the tension roller is disclosed in JP-A-2006-151651.

In some cases, when winding the recording medium, it is possible to suppress occurrence of defects when winding the recording medium by applying tension to the recording medium and winding the recording medium.

However, when using the movable tension roller disclosed in JP-A-2006-151651, in some cases, it is difficult to apply a desired tension to the recording medium (it is difficult to maintain a state in which a desired tension is applied) by moving the tension roller. If a desired tension is not applied to the recording medium, wrinkles, winding deviation, or sagging occurs in the wound recording medium, or banding (band irregularities) and the like may occur in a recorded image. Thus, it is preferable that the tension be applied to the recording medium without using the movable tension roller, the recording medium be wound, and an occurrence of defects be suppressed by applying a desired tension to the recording medium when winding the recording medium.

SUMMARY

An advantage of some aspects of the invention is to suppress an occurrence of defects when winding a recording medium.

According to an aspect of the invention, there is provided a recording apparatus including: a transportation section of a recording medium; a winding section of the recording medium; and a control section that controls transportation of the recording medium by controlling the transportation section and the winding section, in which the control section switches a threshold of a torque limit of the winding section when winding the recording medium at the winding section by synchronizing with an operation of the transportation section.

In this case, the control section switches the torque limit threshold of the winding section by synchronizing with the operation of the transportation section and controls the recording medium so as to be wound at the winding section. Thus, for example, it is possible to switch the torque limit threshold and to wind the recording medium at the winding section so that the torque of the winding section becomes an appropriate value by synchronizing with an operation of operation contents depending on the operation contents of transportation section such as acceleration drive, constant speed drive, and deceleration drive. The torque limit threshold is switched so that the torque of the winding section becomes the appropriate value. Thus, it is possible to apply a desired tension to the recording medium.

The control section may start acceleration drive of the winding section by synchronizing with start of acceleration drive of the transportation section.

In this case, the acceleration drive of the winding section is started by synchronizing with the start of the acceleration drive of the transportation section. Thus, when starting the acceleration drive of the transportation section, a timing of the acceleration drive of the winding section is delayed and thereby it is possible to suppress the tension from not being applied to the recording medium.

The control section may switch the threshold when a drive speed of the transportation section reaches a predetermined speed or when a predetermined period elapses from the start of the acceleration drive of the transportation section.

Generally, the transportation section is driven in order of the acceleration drive, the constant speed drive, and the deceleration drive when transporting the recording medium.

In this case, the control section switches the threshold when the drive speed of the transportation section reaches a predetermined speed or when a predetermined period elapses from the start of the acceleration drive of the transportation section. Thus, the control section determines that the transportation section moves from the acceleration drive to the constant speed drive when the drive speed of the transportation section reaches a predetermined speed or when a predetermined period elapses from the start of the acceleration drive of the transportation section, and can switch the torque limit threshold.

The control section may perform overload detection detecting that a torque of the winding section exceeds the threshold after stopping of driving of the transportation section, and may switch the threshold after detecting the overload.

In this case, the control section performs the overload detection detecting that the torque of the winding section exceeds the threshold after stopping of driving of the transportation section and switches the threshold after detecting the overload. Thus, it is possible to suppress the torque from being excessively applied to the winding section after stop of the drive of the transportation section.

According to another aspect of the invention, there is provided a winding method of a recording medium in a recording apparatus including a transportation section of the recording medium and a winding section of the recording medium, the method including: switching a threshold of a torque limit of the winding section when winding the recording medium at the winding section by synchronizing with an operation of the transportation section.

In this case, the torque limit threshold of the winding section is switched by synchronizing with the operation of the transportation section and the recording medium is wound at the winding section. Thus, for example, it is possible to switch the torque limit threshold and to wind the recording medium at the winding section so that the torque of the winding section becomes an appropriate value by synchronizing with an operation of operation contents depending on the operation contents of the transportation section such as acceleration drive, constant speed drive, and deceleration drive. The torque limit threshold is switched so that the torque of the winding section becomes the appropriate value. Thus, it is possible to apply a desired tension to the recording medium.

Acceleration drive of the winding section may be started by synchronizing with start of acceleration drive of the transportation section.

In this case, the acceleration drive of the winding section is started by synchronizing with the start of the acceleration drive of the transportation section. Thus, when starting the acceleration drive of the transportation section, a timing of the acceleration drive of the winding section is delayed and thereby it is possible to suppress the tension from not being applied to the recording medium.

The threshold may be switched when a drive speed of the transportation section reaches a predetermined speed or when a predetermined period elapses from the start of the acceleration drive of the transportation section.

In this case, the threshold is switched when the drive speed of the transportation section reaches a predetermined speed or when a predetermined period elapses from the start of the acceleration drive of the transportation section. Thus, an appropriate timing at which the transportation section performs the drive from the acceleration drive to the constant speed drive or the like is determined when the drive speed of the transportation section reaches a predetermined speed or when a predetermined period elapses from the start of the acceleration drive of the transportation section. It is possible to switch the torque limit threshold so that the torque of the winding section becomes an appropriate value.

Overload detection detecting that a torque of the winding section exceeds the threshold may be performed after stopping of the drive of the transportation section, and the threshold may be switched after detecting the overload.

In this case, the overload detection detecting that the torque of the winding section exceeds the threshold is performed after stopping of the drive of the transportation section and the threshold is switched after detecting the overload. Thus, it is possible to suppress the torque from being excessively applied to the winding section after stopping of the drive of the transportation section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described with reference to the accompanying drawings.

Figure 1:
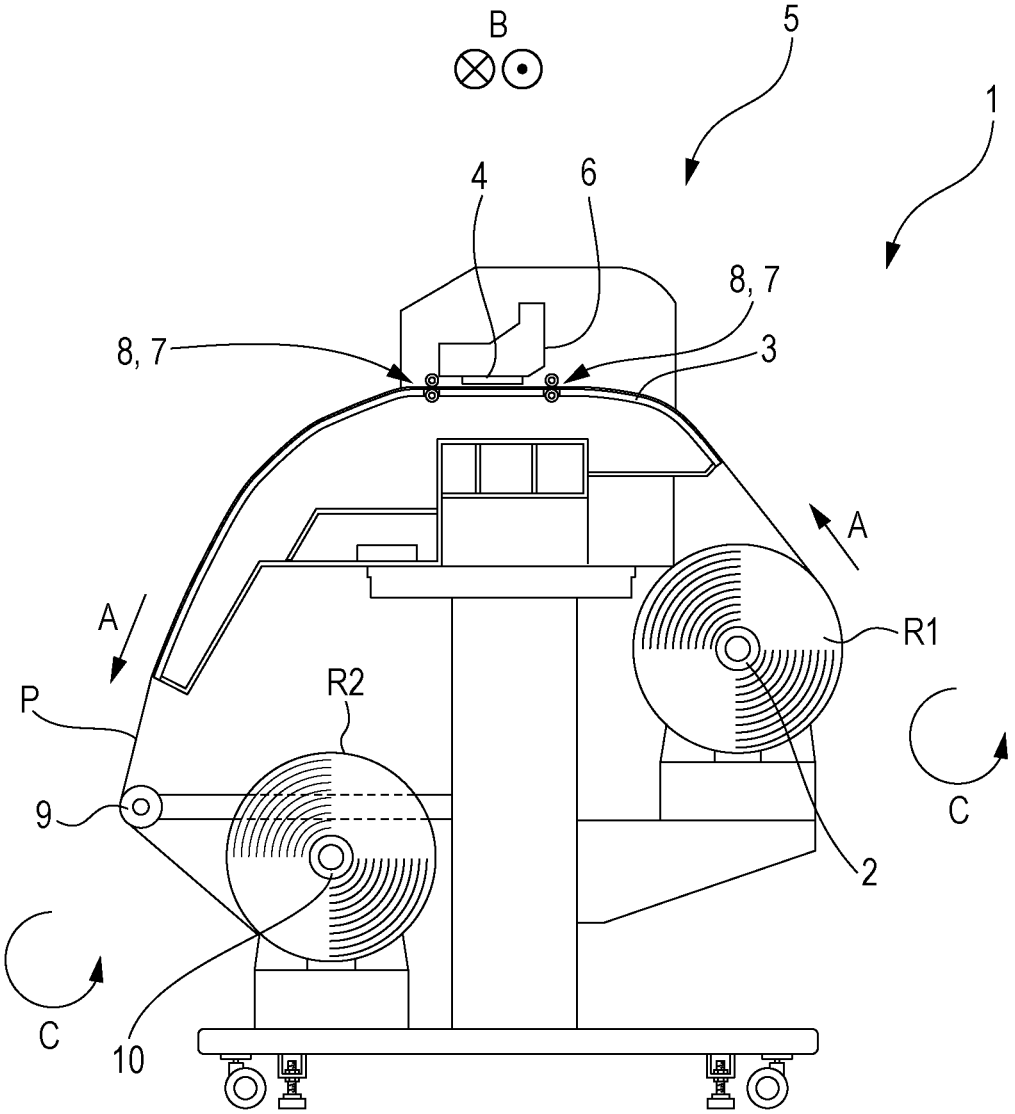
FIG. 1 is a schematic side view illustrating a recording apparatus according to an embodiment of the invention.
Figure 2:
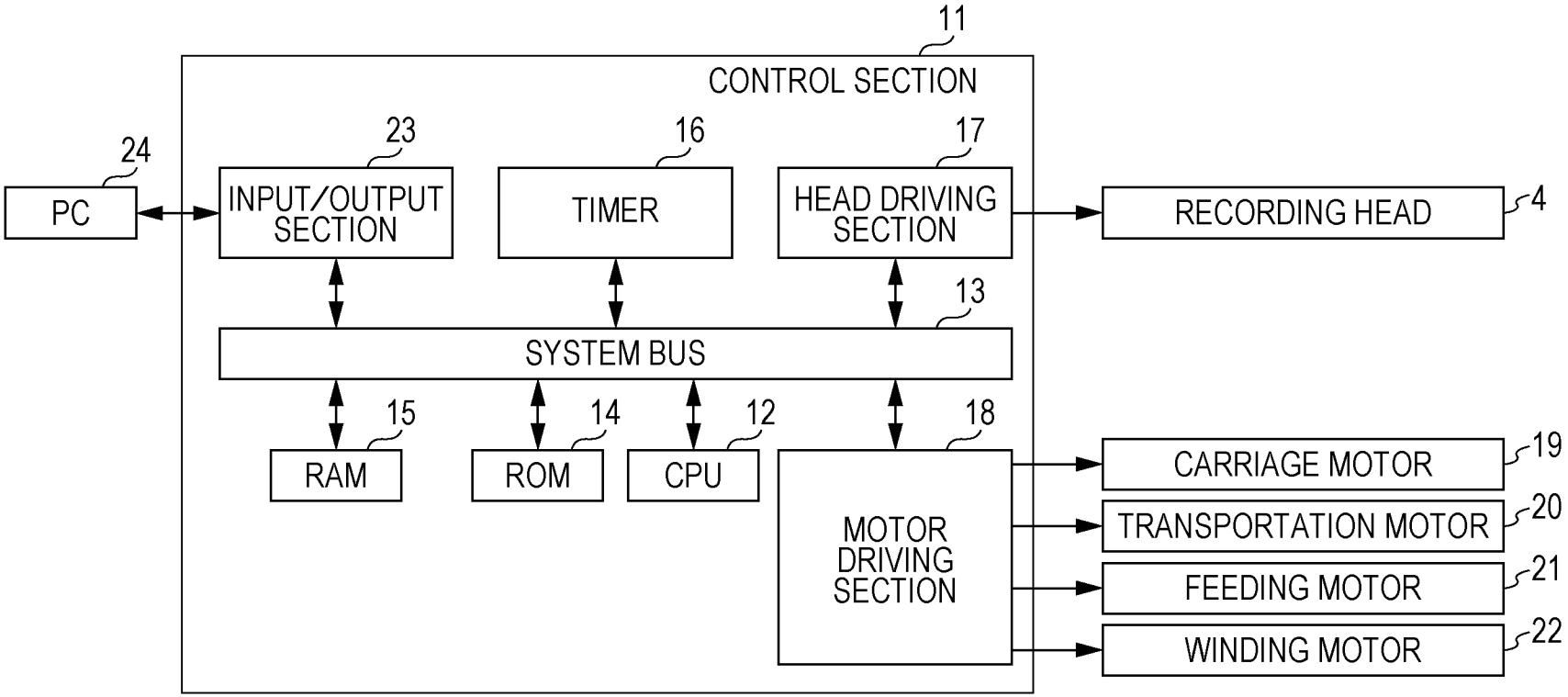
FIG. 2 is a block diaphragm of the recording apparatus according to the embodiment of the invention.
Figure 3:
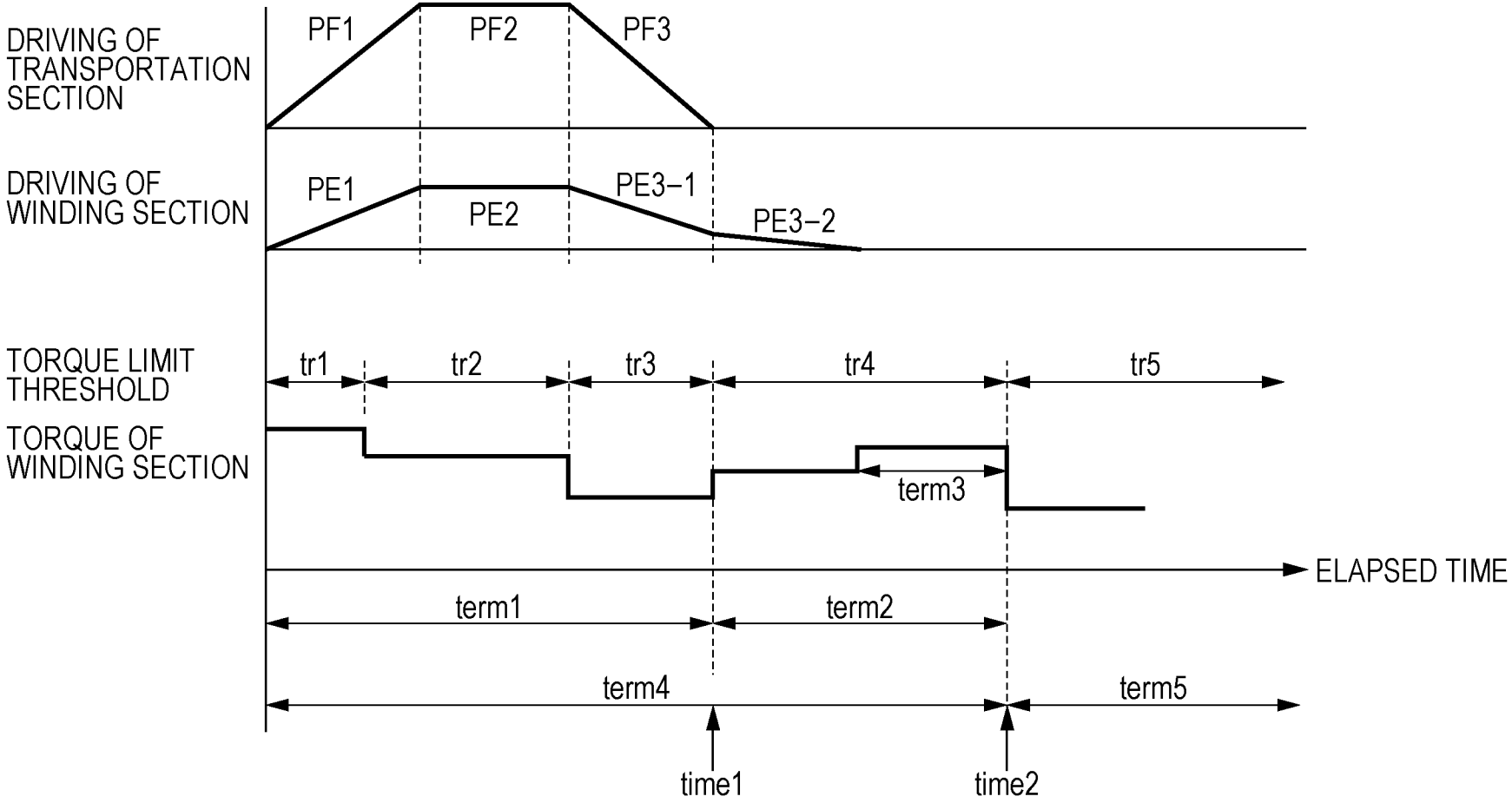
FIG. 3 is a timing chart when winding a recording medium of the recording apparatus according to the embodiment of the invention.

Embodiment of Recording Apparatus (FIGS. 1 to 3)

Initially, the recording apparatus according to the embodiment of the invention will be described.

FIG. 1 is a schematic side view illustrating a recording apparatus 1 according to the embodiment.

The recording apparatus 1 of the embodiment includes a support shaft 2 as a medium setting section that supports a roll R1 of a roll-shaped recording medium P to record. Then, when the recording apparatus 1 of the embodiment transports the recording medium P in a transporting direction A, the support shaft 2 rotates in a rotation direction C. Moreover, in the embodiment, the roll type recording medium P that is wound such that a recording surface is on the outside is used, but if a roll type recording medium P that is wound such that the recording surface is on the inside is used, the support shaft 2 rotates reversely to the rotation direction C and it is possible to feed the roll R1.

Furthermore, the recording apparatus 1 of the embodiment includes a medium support section 3 that supports the recording medium P and a transportation section 7 that is configured of a pair of transportation rollers 8 to transport the recording medium P in the transporting direction A. Furthermore, a heater (not illustrated) capable of heating the recording medium P supported on the medium support section 3 is provided in a lower portion of the medium support section 3.

Moreover, as a heater, the recording apparatus 1 of the embodiment includes a heater capable of heating the recording medium P from the medium support section 3 side, but may include an infrared heater and the like provided in a position facing the medium support section 3. When using the infrared heater, a preferable infrared wavelength is 0.76 μm to 1000 μm. Generally, infrared radiation is further divided into near infrared, mid-infrared, and far infrared radiation by wavelength, and definition of classification varies, but approximate wavelength ranges are 0.78 μm to 2.5 μm, 2.5 μm to 4.0 μm, and 4.0 μm to 1000 μm. Among them, it is preferable that mid-infrared radiation be used.

Furthermore, the recording apparatus 1 of the embodiment includes a recording mechanism 5 in which a recording head 4 as a recording section is mounted on a carriage 6 in a direction B crossing the transporting direction A of the recording medium P and which performs recording by ejecting ink from nozzles of a nozzle surface in which a plurality of nozzles are provided while reciprocally scanning the recording head 4.

Moreover, the recording apparatus 1 of the embodiment includes the recording head 4 that performs recording while reciprocating, but the recording apparatus 1 may be a recording apparatus including a so-called line head in which a plurality of nozzles ejecting the ink are provided in a direction crossing the transporting direction A.

Here, the "line head" is a recording head that is used in a recording apparatus, in which a region of the nozzles formed in the direction B crossing the transporting direction A of the recording medium P is provided so as to cover an entirety of the recording medium P in the direction B, and one of the recording head and the recording medium being fixed and the other moving to form an image. Moreover, a region of the nozzles of the line head in the direction B may not cover the entirety of all recording media P corresponding to the recording apparatus in the direction B.

Furthermore, a recording apparatus having a recording section other than a so-called ink jet type recording head described above may be provided.

Furthermore, a winding shaft 10 is provided on a downstream side of the recording mechanism 5 in the transporting direction A of the recording medium P as a winding section capable of winding the recording medium P as a roll R2. Moreover, in the embodiment, since the recording medium P is wound such that the recording surface is on the outside, when winding the recording medium P, the winding shaft 10 rotates in the rotation direction C. In contrast, when winding the recording medium P such that the recording surface is on the inside, it is possible to wind the recording medium P by rotating the winding shaft 10 reversely to the rotation direction C.

Furthermore, a contact section with the recording medium P extends in the direction B between an end portion of the recording medium P on the downstream side in the transporting direction A in the medium support section 3 and the winding shaft 10. A fixed type bar member 9 configuring a transportation path of the recording medium P is provided between the end portion and the winding shaft 10.

Next, an electrical configuration in the recording apparatus 1 of the embodiment will be described.

FIG. 2 is a block diaphragm of the recording apparatus 1 according to the embodiment.

A control section 11 is provided with a CPU 12 performing control of an entirety of the recording apparatus 1. The CPU 12 is connected to a ROM 14 storing various control programs that are performed by the CPU 12, a RAM 15 capable of temporarily storing data, and a timer 16 capable of measuring time through a system bus 13.

Furthermore, the CPU 12 is connected to a head driving section 17 for driving the recording head 4 through the system bus 13.

Furthermore, the CPU 12 is connected to a motor driving section 18 connected to a carriage motor 19, a transportation motor 20, a feeding motor 21, and a winding motor 22 through the system bus 13.

Here, the carriage motor 19 is a motor for moving the carriage 6 on which the recording head 4 is mounted in the direction B. Furthermore, the transportation motor 20 is a motor for driving the pair of transportation rollers 8 provided in the transportation section 7. Furthermore, the feeding motor 21 is a rotation mechanism of the support shaft 2 and a motor for driving the support shaft 2 to feed the recording medium P to the transportation section 7. Furthermore, the winding motor 22 is a driving motor for rotating the winding shaft 10.

Furthermore, the CPU 12 is connected to an input/output section 23 connected to a PC 24 through the system bus 13 to receive/transmit data such as recording data and a signal.

Next, drive timing of the transportation section 7 and the winding shaft 10, a threshold of a torque limit, and a torque of the winding section when winding the recording medium P in the recording apparatus 1 of the embodiment will be described.

FIG. 3 is a timing chart when winding the recording medium P in the recording apparatus 1 according to the embodiment.

Moreover, the recording apparatus 1 of the embodiment can transport the recording medium P reversely to the transporting direction A. Then, "relationship between the drive timing of the transportation section 7 and the support shaft 2, the torque limit threshold, and the torque of the support shaft 2 when reversely transporting the recording medium P" is similar to "relationship between the drive timing of the transportation section 7 and the winding shaft 10 (winding section), the torque limit threshold, and the torque of the winding shaft 10 when winding the recording medium P". That is, the following description is applied to "relationship between the drive timing of the transportation section 7 and the support shaft 2, the torque limit threshold, and the torque of the support shaft 2 when reversely transporting the recording medium P".

A transportation instruction for the recording medium P is input, the control section 11 controls the transportation section 7 and the winding shaft 10 so as to start acceleration drive and thereby acceleration drive PF1 of the transportation section 7 is synchronized with acceleration drive RE1 of the winding shaft 10. At this time, the torque limit threshold of the winding shaft 10 is set to be a torque limit threshold tr1 by the control section 11.

Moreover, driving of the winding shaft 10 is controlled by the torque limit and speed control is performed so as not to exceed a predetermined upper limit speed. Thus, if the torque of the winding shaft 10 is the torque limit, the winding shaft 10 is driven in a state where the torque is the torque limit, but if the torque of the winding shaft 10 is not the torque limit, the winding shaft 10 is driven corresponding to the speed control. That is, in a case where the torque of the winding shaft 10 is not the torque limit, when the drive speed of the winding shaft 10 is slow, the winding shaft 10 is accelerated, but the upper limit speed is the upper limit.

Because of such a configuration, in the recording apparatus 1 of the embodiment, driving of the winding shaft 10 is unlikely to be influenced by external disturbances. Thus, for example, it is possible to stabilize driving of the winding shaft 10 (apply a stable predetermined tension to the recording medium P) regardless of a configuration of a medium setting section feeding the recording medium P to the transportation section 7 and the like. Moreover, the support shaft 2 and the winding shaft 10 are provided with a torque limiter (not illustrated) respectively.

Furthermore, in the recording apparatus 1 of the embodiment, the transportation section 7 and the winding shaft 10 are driven by setting a moving speed of the recording medium P when the recording medium P is wound by the winding shaft 10 faster than the transportation speed of the transportation section 7 for transporting the recording medium P. Thus, in a state where tension is applied to the recording medium P in a direction along the transporting direction A, the transportation and winding of the recording medium P is performed.

Furthermore, in the recording apparatus 1 of the embodiment, when a drive mode of the transportation section 7 moves from the acceleration drive PF1 to a constant speed drive PF2, the control section 11 performs control such that the torque limit threshold is switched from the torque limit threshold tr1 to the torque limit threshold tr2.

Here, the transportation section 7 is provided with an encoder, a state of the speed of the transportation section 7 is recognized from a reading value of the encoder, and the control section 11 determines that the drive mode of the transportation section 7 moves from the acceleration drive PF1 to the constant speed drive PF2. Moreover, when the drive mode of the transportation section 7 moves from the acceleration drive PF1 to the constant speed drive PF2, the drive mode of the winding shaft 10 moves from the acceleration drive RE1 to a constant speed drive RE2.

Furthermore, in the recording apparatus 1 of the embodiment, the control section 11 performs measurement of time from a start time of the acceleration drive PF1 of the transportation section 7 by the timer 16 and performs control such that the torque limit threshold is switched from the torque limit threshold tr1 to the torque limit threshold tr2.

That is, the control section 11 of the embodiment switches the torque limit threshold from the torque limit threshold tr1 to the torque limit threshold tr2 in earlier timing at which it is determined that the drive mode of the transportation section 7 moves from the acceleration drive PF1 to the constant speed drive PF2 and at which a predetermined period elapses. Moreover, FIG. 3 illustrates a case where the timing is earlier than the timing at which the predetermined period elapses.

Furthermore, in the recording apparatus 1 of the embodiment, the control section 11 determines that the drive mode of the transportation section 7 moves from the constant speed drive PF2 to a deceleration drive PF3 from the reading value of the encoder. Then, when the drive mode of the transportation section 7 moves from the constant speed drive PF2 to the deceleration drive PF3, control is performed to switch the torque limit threshold from the torque limit threshold tr2 to a torque limit threshold tr3.

Moreover, when the drive mode of the transportation section 7 moves from the constant speed drive PF2 to the deceleration drive PF3, the drive mode of the winding shaft 10 moves from the constant speed drive RE2 to a deceleration drive RE3-1. Then, when the transportation section 7 stops, the drive mode of the winding shaft 10 moves from the deceleration drive RE3-1 to a deceleration drive RE3-2. Performing such an operation is caused by deviation of the operation of the winding shaft 10 with respect to the operation of the transportation section 7 occurring when the operations of the transportation section 7 and the winding shaft 10 are synchronized to continuously apply a predetermined tension to the recording medium P.

Then, if it is determined that driving of the transportation section 7 is stopped from the reading value of the encoder, the control section 11 performs control of switching the torque limit threshold from the torque limit threshold tr3 to a torque limit threshold tr4.

As described above, in a drive period term 1 of the transportation section 7, the torque limit threshold is switched to the torque limit threshold tr1, the threshold tr2, and the torque limit threshold tr3.

Then, overload detection detecting that the torque of the winding shaft 10 exceeds the torque limit threshold tr4 from a time time1 of a time point when the drive period term1 of the transportation section 7 is completed is performed.

Moreover, the maximum overload detection performing period term2 for detecting the overload in the recording apparatus 1 of the embodiment is 3 seconds and when detecting an overload detection period term3 (period in which the torque of the winding shaft 10 exceeds the torque limit threshold tr4) of 0.3 seconds during this period, the control section 11 controls the torque limit threshold to be switched from the torque limit threshold tr4 to a torque limit threshold tr5.

Moreover, if the overload detection period term3 of 0.3 seconds does not generated in the overload detection performing period term2, the control section 11 decelerates and stops the winding shaft 10 and can stop the control of the winding shaft 10. Furthermore, if three times of the overload detection period term3 of 0.3 seconds in the overload detection performing period term2 are not continuously generated, error information can be output to the PC 24.

Then, the control section 11 keeps the torque limit threshold at the torque limit threshold tr5 during a predetermined period term5, from the time time2 at which the torque limit threshold is switched from the torque limit threshold tr4 to the torque limit threshold tr5. Then, when the predetermined period term5 elapses, the control section 11 stops the control of the winding shaft 10.

Moreover, the term4 formed of the term1 and the term2 corresponds to a so-called MAP control period in which the winding shaft 10 is controlled to have a speed and the term5 corresponds to a so-called press control holding the winding shaft 10 to which a constant torque is applied.

Moreover, an outer diameter of the roll R2 of the recording medium P is formed of a configuration that can be estimated and the drive speed of the transportation section 7 and the winding shaft 10 may be formed of a configuration that can be changed according to an estimated outer diameter.

Furthermore, the configuration may be a configuration having a plurality of drive modes in which the drive speeds of the transportation section 7 and the winding shaft 10 are different from each other.

As described above, the recording apparatus 1 of the embodiment includes the transportation section 7 of the recording medium P, the winding shaft 10 as the winding section of the recording medium P, and the control section 11 that controls the transportation of the recording medium P by controlling the transportation section 7 and the winding shaft 10. Then, the control section 11 switches the torque limit threshold of the winding shaft 10 by synchronizing with the operation of the transportation section 7 and controls the winding shaft 10 such that it winds the recording medium P.

Thus, as described above, the torque limit threshold is switched and the recording medium P is wound at the winding shaft 10 so that the torque of the winding shaft 10 becomes an appropriate value by synchronizing with the operation of the operation contents depending on the operation contents of the transportation section 7 such as the acceleration drive, the constant speed drive, and the deceleration drive. Then, it is possible to apply a desired tension to the recording medium P by switching the torque limit threshold such that the torque of the winding shaft 10 becomes an appropriate value and it is possible to suppress an occurrence of defects when winding the recording medium P without using the movable tension roller.

Moreover, "switching the torque limit threshold of the winding shaft 10 by synchronizing with the operation of the transportation section 7" means that switching the threshold by synchronizing with a part of the drive operation of the transportation section 7 in addition to switching the threshold by synchronizing with an entirety of the drive operation of the transportation section 7.

Furthermore, as described above, the control section 11 of the embodiment starts the acceleration drive RE1 of the winding shaft 10 by synchronizing with the start of the acceleration drive PF1 of the transportation section 7.

Thus, when starting the acceleration drive PF1 of the transportation section 7, the acceleration drive timing of the winding shaft 10 is delayed so that it is possible to suppress tension from not being applied to the recording medium P.

Furthermore, as described above, the control section 11 of the embodiment switches the threshold when the drive speed of the transportation section 7 reaches a predetermined speed (constant speed drive PF2) or when a predetermined period elapses from the start of the acceleration drive PF1 of the transportation section 7.

As the recording apparatus 1 of the embodiment, generally, when transporting the recording medium P, the transportation section 7 is driven in order of the acceleration drive PF1, the constant speed drive PF2, and the deceleration drive PF3.

The control section 11 of the embodiment switches the threshold when the drive speed of the transportation section 7 reaches a predetermined speed or when a predetermined period elapses from the start of the acceleration drive PF1 of the transportation section 7. Thus, the control section 11 determines that the transportation section 7 moves from the acceleration drive PF1 to the constant speed drive PF2 when the drive speed of the transportation section 7 reaches a predetermined speed or when a predetermined period elapses from the start of the acceleration drive PF1 of the transportation section 7 and the torque limit threshold is switched.

Furthermore, as described above, the control section 11 of the embodiment performs the overload detection detecting that the torque of the winding shaft 10 exceeds the threshold after driving of the transportation section 7 is stopped and switches the threshold after detecting the overload.

Thus, it is possible to suppress the torque from being excessively applied to the winding shaft 10 after driving of the transportation section 7 is stopped.

Next, a specific calculation method of the torque limit threshold will be described.

Initially, a rotation load (current value that flows when the winding shaft 10 rotates, hereinafter, referred to as a measurement value) of the winding shaft 10 in the initial state is measured from two types of rotational speeds of a low speed and high speed and a relationship between the rotational speed and the measurement value with respect to a period of the encoder provided in the winding shaft 10 is obtained.

Here, the measured rotational speed at the low speed is referred to as x1 and the rotational speed at the high speed is referred to as x2.

Furthermore, an average measurement value in a Proportional Integral Derivative Controller (PID control) is also calculated corresponding to two types of rotational speeds of the low speed and high speed of the winding shaft 10.

Here, the average measurement value at the low speed is referred to as y3 and the average measurement value at the high speed is referred to as y4.

Then, when the torque limit threshold is tr, tr is represented as follows.

$$tr = \frac{(F \times D \times \mathrm{V_KT})}{2^{BIT_V_KT}} + \frac{(y4 - y3)}{(x2 - x1)} \times X + y3 - \frac{(y4 - y3) \times x1}{(x2 - x1)} \quad \text{Expression 1}$$

Here, F is the tension applied to the recording medium P, D is the outer diameter of the roll of the recording medium P, and V_KT is a coefficient converting the tension F into the torque limit. Furthermore, X is the rotational speed of the winding shaft 10. For example, the torque limit threshold tr is a short period such as 1 μsec to 1 msec and is calculated at any time. When the control section 11 determines that the torque limit threshold is switched, a value calculated immediately before is used. That is, the control section 11 performs control to switch the torque limit threshold using the torque limit threshold tr calculated when closest to the timing at which it is determined that the speed is changed, for example, the speed of the transportation section 7 is changed from the acceleration state to the constant speed (also including the stop state), and from the constant speed (also including the stop state) to the deceleration, a degree of the acceleration or deceleration is changed so as to move each drive state of PF1, PF2, and PF3 illustrated in FIG. 3.

Moreover, for the tension F applied to the recording medium P, tension F1 is applied in the acceleration drive PF1 in the torque limit threshold tr1, tension F2 is applied in the constant speed drive PF2 in the torque limit threshold tr2, tension F3 is applied in the deceleration drive PF3 in the torque limit threshold tr3, tension F4 is applied in the term2 in the torque limit threshold tr4, and tension F5 is applied in the term5 in the torque limit threshold tr5.

Next, a winding method according to an embodiment of the invention will be described with reference to a flowchart.

Figure 4:
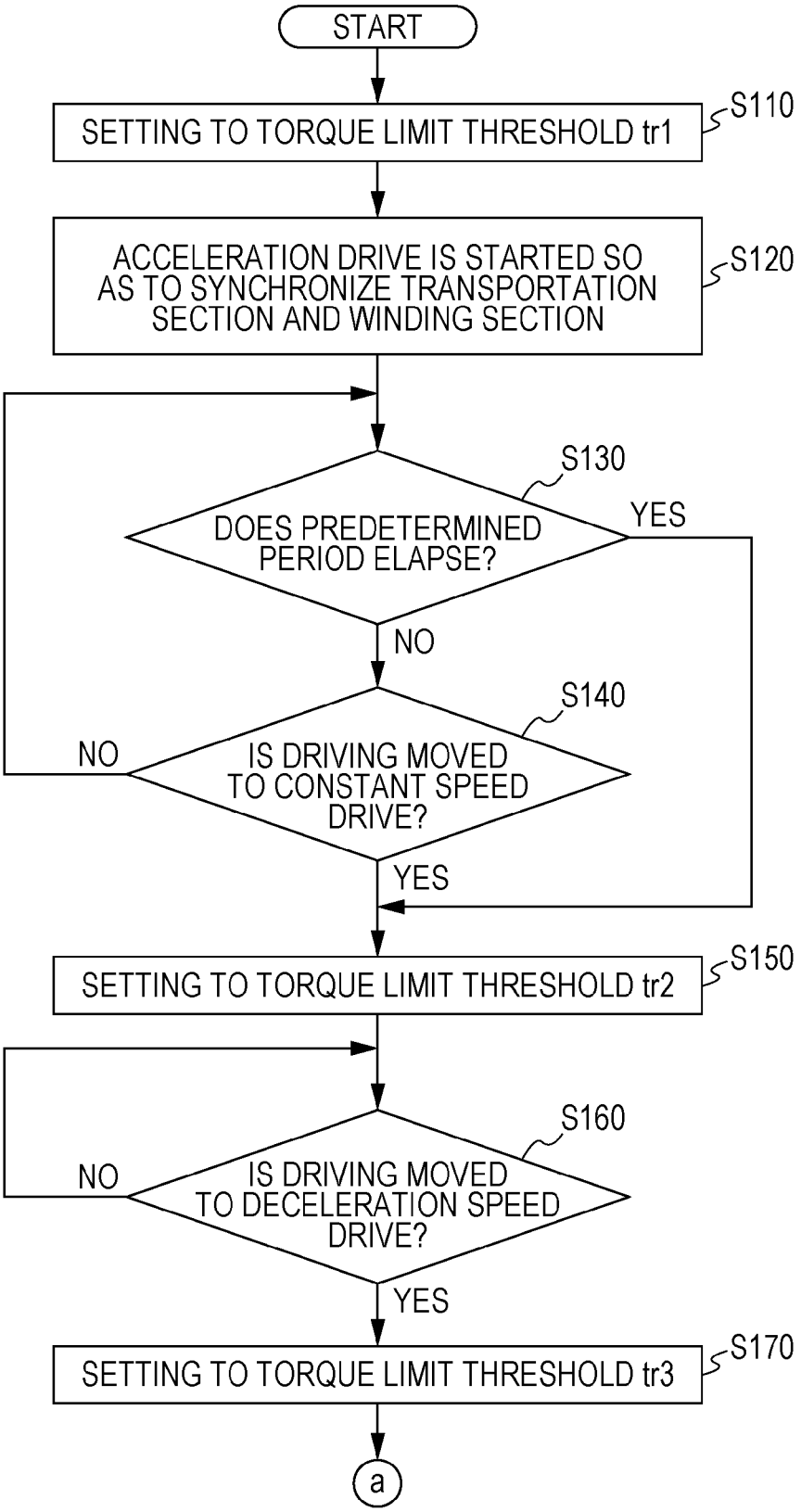
FIG. 4 is a flowchart of a winding method according to the embodiment of the invention.
Figure 5:
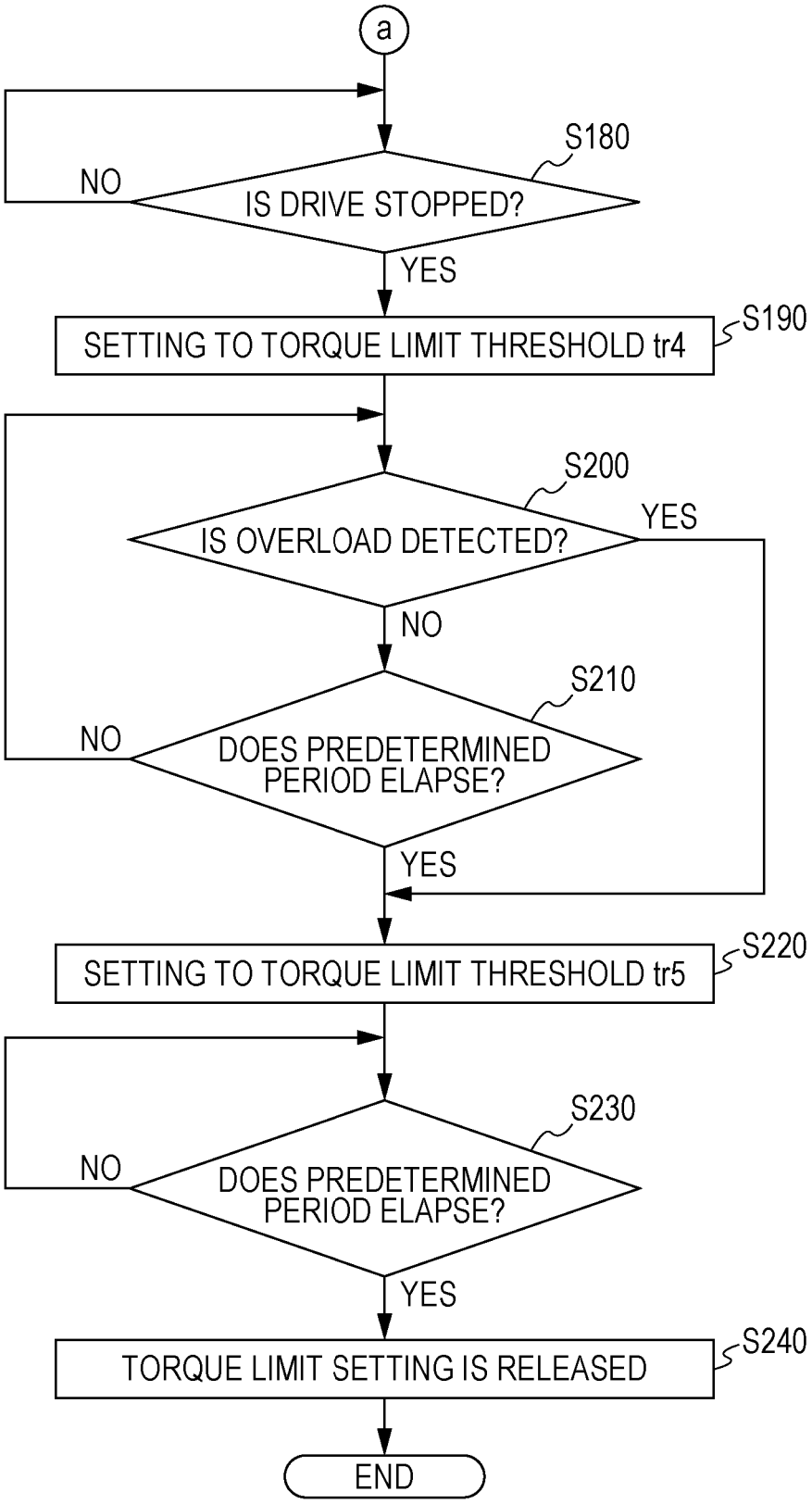
FIG. 5 is a flowchart of the winding method according to the embodiment of the invention.

Embodiment of Winding Method (FIGS. 4 and 5)

FIGS. 4 and 5 are flowcharts of the winding method of the embodiment.

Initially, when the control section 11 inputs a transportation instruction of the recording medium P, in step S110, the control section 11 sets the torque limit threshold to be the torque limit threshold tr1.

Next, in step S120, the acceleration drive of the transportation section 7 and the winding shaft 10 is started by the control of the control section 11 and thereby the acceleration drive PF1 of the transportation section 7 and the acceleration drive RE1 of the winding shaft 10 are synchronized.

Next, in step S130, the control section 11 determines whether or not a measured time from the start time of the acceleration drive PF1 of the transportation section 7 elapses a predetermined period by the timer 16 and if it is determined that the predetermined period is not elapsed, in step S140, it is determined whether or not driving of the transportation section 7 moves to the constant speed drive RE2.

Thus, the process proceeds to step S150 at earlier timing at which it is determined that the drive mode of the transportation section 7 moves from the acceleration drive PF1 to the constant speed drive PF2 and when a predetermined period elapses by step S130 and step S140 in the control section 11.

Then, in step S150, the control section 11 switches the torque limit threshold from the torque limit threshold tr1 to the torque limit threshold tr2.

Next, in step S160, the control section 11 determines whether or not driving of the transportation section 7 moves to the deceleration drive PF3.

Then, if it is determined that the drive moves to the deceleration drive PF3, in step S170, the control section 11 switches the torque limit threshold from the torque limit threshold tr2 to the torque limit threshold tr3.

Next, in step S180, the control section 11 determines whether or not driving of the transportation section 7 is stopped.

Then, if it is determined that driving of the transportation section 7 is stopped, in step S190, the control section 11 switches the torque limit threshold from the torque limit threshold tr3 to the torque limit threshold tr4.

Next, in step S200 and step S210, the control section 11 performs the overload detection during 3 seconds that is the predetermined period.

Then, when detecting the overload during 0.3 seconds, the control section 11 switches the torque limit threshold from the torque limit threshold tr4 to the torque limit threshold tr5 in step S220.

Moreover, the control section 11 determines that the detection of the overload is a current value flowing in the winding shaft 10.

Then, elapse of the predetermined period is waited in step S230 and setting of the torque limit threshold is released in step S240, and the winding method of the embodiment is completed.

The entire disclosure of Japanese Patent Application No. 2014-23084, filed Feb. 10, 2014 is expressly incorporated by reference herein.

What is claimed is:

1. A recording apparatus comprising:

a transportation section of a recording medium;

a winding section of the recording medium; and a control section that controls transportation of the recording medium by controlling the transportation section and the winding section, wherein the control section varies a torque limit threshold of the winding section according to whether the winding section is accelerating, operating at a constant speed, or decelerating.

2. The recording apparatus according to claim 1, wherein the control section starts acceleration drive of the winding section by synchronizing with start of acceleration drive of the transportation section.

3. The recording apparatus according to claim 1, wherein the control section switches the torque limit threshold when a drive speed of the transportation section reaches a predetermined speed or when a predetermined period elapses from the start of the acceleration drive of the transportation section.

4. The recording apparatus according to claim 1, wherein the control section performs overload detection by detecting that a torque of the winding section exceeds the torque limit threshold after stopping of driving of the transportation section, and the control section switches the torque limit threshold after detecting the overload.

5. A winding method of a recording medium in a recording apparatus including a transportation section of the recording medium and a winding section of the recording medium, the method comprising:

varying a threshold of a torque limit of the winding section according to whether the winding section is accelerating, operating at a constant speed, or decelerating.

6. The winding method according to claim 5, further comprising:

switching the torque limit threshold when a drive speed of the transportation section reaches a predetermined speed or when a predetermined period elapses from the start of the acceleration of the transportation section.

7. The winding method according to claim 5, further comprising:

performing overload detection detecting that a torque of the winding section exceeds the torque limit threshold after stopping of driving of the transportation section, and switching the torque limit threshold after detecting the overload.

8. The recording apparatus as recited in claim 1, wherein the control section causes a substantially constant tension to be maintained in the recording medium.

9. The winding method according to claim 5, wherein the method includes maintaining a substantially constant tension in the recording medium.

* * * * *